US005113781A

United States Patent [19]

Link

[11] Patent Number: 5,113,781

[45] Date of Patent: May 19, 1992

[54] DETACHABLE PROTECTIVE COVER FOR WOODEN RAILS OF BOATS

[76] Inventor: Terry G. Link, 421 Hempstead Pl., Charlotte, N.C. 28207

[21] Appl. No.: 640,607

[22] Filed: Jan. 14, 1991

[51] Int. Cl.[5] ..... B63B 17/00

[52] U.S. Cl. ..... 114/361; 114/364; 150/166; 296/153

[58] Field of Search ..... 114/361, 364; 150/154, 150/155, 158, 166, 153, 41; 296/153; 280/720

[56] References Cited

U.S. PATENT DOCUMENTS

| | | | |
|---|---|---|---|
| 1,625,791 | 4/1927 | Campbell | 296/153 |
| 2,817,859 | 12/1957 | McCarthy | 114/361 |
| 2,926,362 | 3/1960 | Collins et al. | 114/361 |
| 2,937,652 | 5/1960 | Zimmer et al. | 114/361 |
| 3,192,542 | 7/1965 | Mills | 114/361 |
| 4,653,420 | 3/1987 | Johnson | 114/361 |
| 4,694,774 | 9/1987 | Keithley | 114/361 |
| 4,719,952 | 1/1988 | Geronimo | 114/361 |

FOREIGN PATENT DOCUMENTS

| | | | |
|---|---|---|---|
| 425968 | 3/1926 | Fed. Rep. of Germany | 114/361 |

*Primary Examiner*—Sherman Basinger
*Assistant Examiner*—Thomas J. Brahan
*Attorney, Agent, or Firm*—Bell, Seltzer, Park & Gibson

[57] ABSTRACT

A fabric cover is disclosed which is adapted to removably engage and protect the wooden rail of a powerboat or sailboat. The cover comprises a sheet of fabric material having a plurality of longitudinally spaced apart pockets on one side of the fabric sheet, and a resilient ring of generally C-shaped cross sectional configuration positioned in each of the pockets. The rings cause the fabric sheet to assume a conforming C-shaped outline, and they may be manually expanded to permit the pockets to be disposed about the wooden rail, so that they then collapse and encircle the rail upon the release of the expanding force.

8 Claims, 3 Drawing Sheets

DETACHABLE PROTECTIVE COVER FOR WOODEN RAILS OF BOATS

FIELD OF THE INVENTION

This invention relates to protective covers for the wooden rails of boats, and more particularly to a detachable cover for protecting the wooden side rails of a power boat or sailboat.

BACKGROUND OF THE INVENTION

Many types of boats, including sailboats and power boats, commonly include a highly polished and decorative wooden side rail extending along the gunnel. Since all boats are exposed to a wide range of natural elements, including sunlight, extreme heat, extreme cold, rain, fresh water, salt water, hail and sometimes snow or sleet, these side rails rapidly deteriorate unless they are protectively covered.

It is known to use tarpaulins and covers of various design to protect boat surfaces from the natural elements. For example, U.S. Pat. Re. 26,363 to Mills, II entitled *Fabric Covers for Boats* provides a fabric cover for boats which is intended to protect the boat while not in use. The fabric tarpaulin covers the entire boat and is held in place by a series of resilient fastener clips. Use of the fabric tarpaulin in combination with the fastener clips in order to protect the side rails of a boat is unsatisfactory, since it is difficult and unwieldy to handle, and removal of the clips and entire tarp is time consuming. Furthermore, damage can occur to the rails as a result of the contact between the fastener clip and the rail, and damage to the cover itself can occur as a result of the attachment of the fastener clips to the cover.

It is accordingly an object of the present invention to provide a detachable cover for protecting the wooden side rails of a boat against the natural elements and which is easily detachable from the rails with minimum effort, and which will not itself damage the rail.

It is another object of this invention to provide a detachable cover of the described type which will remain securely fixed in place once in position.

SUMMARY OF THE INVENTION

These and other objects and advantages of the present invention are accomplished in accordance with the present invention by a cover for protecting the wooden rail of a power boat or sailboat and which comprises an elongate sheet of fabric material having opposite ends and opposite side edges. Pockets are positioned on one side of the fabric sheet and extend transversely from one side to the other. Each pocket contains a removable "C-shaped" resilient ring, which has closely adjacent circumferential ends which are positioned adjacent respective ones of the opposite side edges of the fabric sheet. The rings thus cause the fabric material to assume a conforming C-shaped outline at each of the spaced apart pockets. The C-shaped rings in the pockets permit manual expansion of the cover about the wooden rail followed by collapse of the rings as well as the cover to encircle the rail once the rings have been released.

The C-shaped rings are preferably made from a plastic material, and in a relaxed state, the rings are approximately 2.5 inches in diameter. Additionally, the pockets preferably are formed from separate strips of similar fabric material, and which are joined to the base fabric sheet along spaced apart transverse lines. The pockets are also joined to the base sheet along one end line which is adjacent one of the side edges of the base fabric sheet, so that an open end is formed adjacent the opposite side edge of the base fabric sheet. Also, each of the strips includes a folded back edge which extends into the associated pocket so as to receive one of the ends of the C-shaped ring and thereby retain the ring in the pocket.

BRIEF DESCRIPTION OF THE DRAWINGS

Some of the objects and advantages of the present invention having been stated, others will appear as the description proceeds, when taken in conjunction with the accompanying drawings, in which.

DETAILED DESCRIPTION OF THE PREFERRED EMBODIMENT

The present invention now will be described more fully hereinafter with reference to the accompanying drawings, in which a preferred embodiment of the invention is shown. This invention may, however, be embodied in many different forms and should not be construed as limited to the embodiment set forth herein; rather, this embodiment is provided so that this disclosure will be thorough and complete, and will fully convey the scope of the invention to those skilled in the art. Like numbers refer to like elements throughout.

Figure 1:
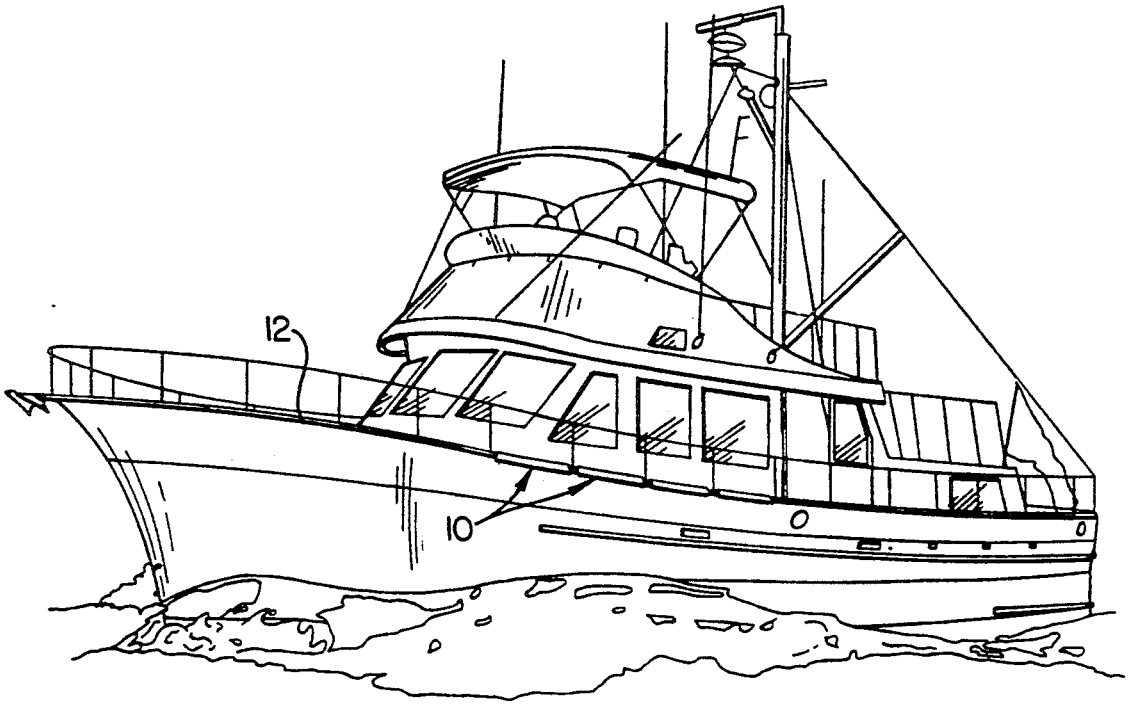
FIG. 1 is a perspective view of a power boat having a plurality of covers which embodies the features of the present invention mounted along one side rail.
Figure 2:
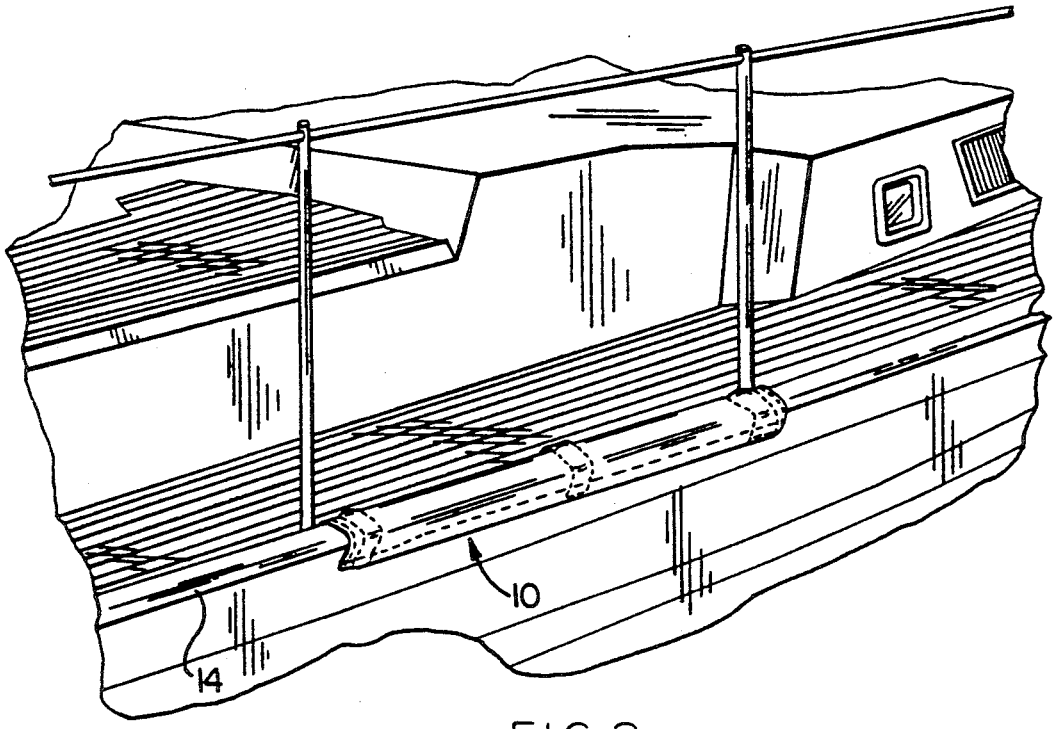
FIG. 2 is a fragmentary perspective view of a sailboat having the cover of the present invention mounted on the wooden side rail of the boat.
Figure 3:
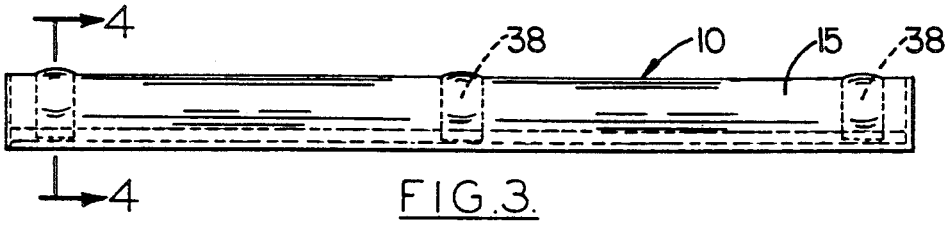
FIG. 3 is a side elevation view of the detachable cover.
Figure 4:
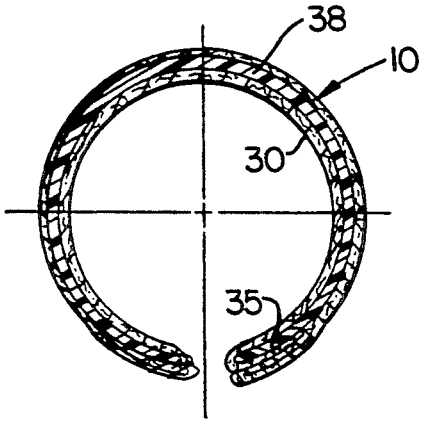
FIG. 4 is a sectional end view of the detachable cover, taken along the line 4—4 of FIG. 3.

A detachable cover which embodies the features of the present invention is indicated generally at 10, and FIG. 1 illustrates the cover 10 mounted on the side rail 12 of a powerboat. FIG. 2 illustrates the cover 10 mounted on the side rail 14 of a sailboat.

The cover 10 of the present invention is illustrated in more detail in FIGS. 3–10. As illustrated, the cover 10 is formed from an elongate sheet of fabric material 15, such as closely woven cotton duck, so as to provide a durable protection for the side rails of the boat. The sheet 15 is of generally rectangular configuration, and it defines opposite ends 16, 17, and opposite side edges 18, 19. In one preferred embodiment, the distance between the opposite side edges 18, 19 of the fabric sheet is between about 8 to 10 inches, and the distance between the opposite ends 16, 17 is at least about two feet.

Figure 10:
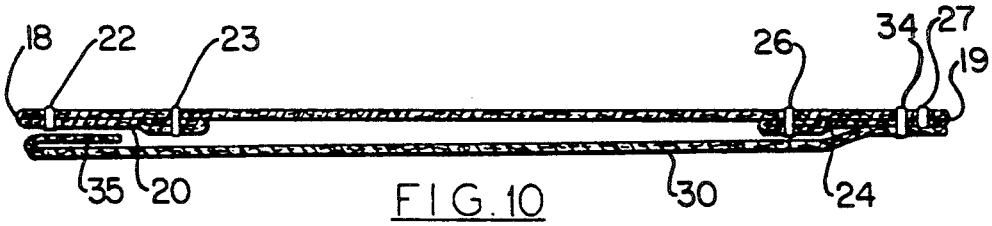
FIG. 10 is a sectional view of the detachable cover and taken along the line 10—10 of FIG. 9.

As best seen in FIG. 10, the side edge 18 includes a molded under portion 20 which is secured by a pair of longitudinal seam lines 22, 23, and the opposite side edge 19 includes a similar folded under portion 24 which is secured by a pair of longitudinal seam lines 26, 27. These four longitudinal seam lines are joined by a transverse seam line 28, 29 adjacent each of the opposite ends.

A plurality of longitudinally spaced apart pockets are formed on one side of the fabric sheet, and each of the pockets is formed by a strip 30 of similar fabric which is sewn to the fabric sheet 15. More particularly, each of the strips 30 extends between the opposite side edges 18, 19 of the sheet, and with the strips being joined to the fabric sheet along two longitudinally spaced apart transverse seam lines 32, 33 and an end seam line 34 adjacent the side edge 19. By this construction, an open end for the pocket is defined adjacent the opposite side edge 18. Also, each of the fabric strips 30 includes a folded back edge 35 which extends into the associated pocket from the open end thereof, for the purposes set forth below.

A resilient ring 38 of generally C-shaped cross sectional configuration is positioned in each of the pockets. In the preferred embodiment, each ring 38 has a diameter of about 2.5 inches in its relaxed state, and the ring includes closely adjacent circumferential ends 40, 41, which in a preferred embodiment are circumferentially spaced apart a distance less than about ½ inches in the relaxed state of the ring. Also, the ring preferably has a wall thickness of about 0.15 inches, and a width of about 0.72 inches.

The ring 38 is preferably fabricated from a plastic material, such as the acetyl polymers sold under the trademarks CELCON and DELRIN. The ring 38 is preferably formed by drilling a solid cylinder of the plastic material, to remove its center core, and then longitudinally cutting the remaining cylinder. Finally, the cylinder is cut transversely to form the individual rings, with the longitudinal cut line forming the ends of the ring. The resulting ring can be manually expanded to substantially increase the distance between the ends 40, 41 of the ring, and it has a high degree of memory so as to return to its initial state with the expansion pressure is released. It will also be understood by those skilled in the art that the ring 38 may be formed using an injection molding technique or it may be fabricated from a suitable metallic material.

A ring 38 is inserted into each of the pockets formed by the strips 30, by threading one of the ends 40, 41 into the open end of the pocket and advancing the end of the ring until it reaches the inner end of the pocket adjacent the side edge 19 of the fabric sheet. When in this position, the other end of the ring may be slipped beneath the folded back edge 35, and so that the ring is retained in the pocket. Also, the resilience of the rings 38 causes the fabric sheet 15 to assume a conforming generally C-shaped outline in transverse cross section at each of the pockets, note for example FIG. 4.

Figure 5:
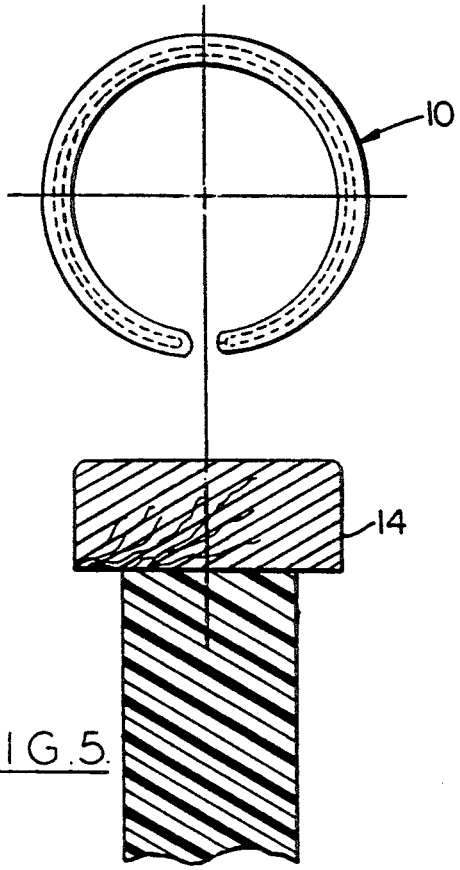
FIG. 5 is an end view of the detachable cover and an adjacent wooden side rail, prior to the expansion of the rings of the cover.
Figure 6:
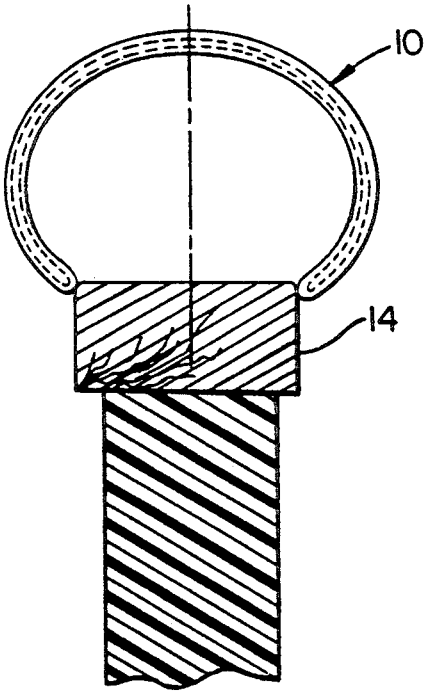
FIG. 6 is a view similar to FIG. 5 but showing the cover expanded and partially assembled on the side rail.
Figure 7:
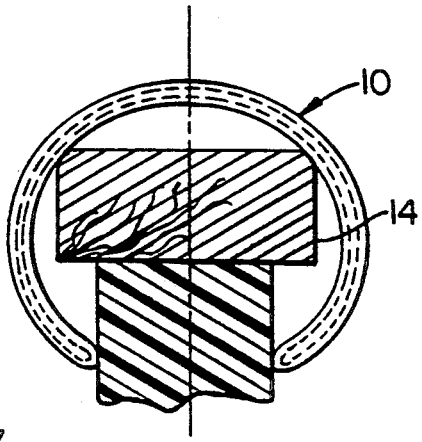
FIG. 7 is a view similar to FIG. 5 and showing the cover in its fully assembled position on the side rail.
Figure 8:
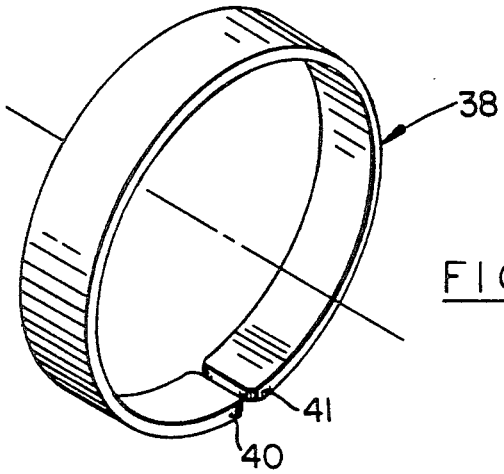
FIG. 8 is a perspective view of a resilient ring as utilized with the present invention.
Figure 9:
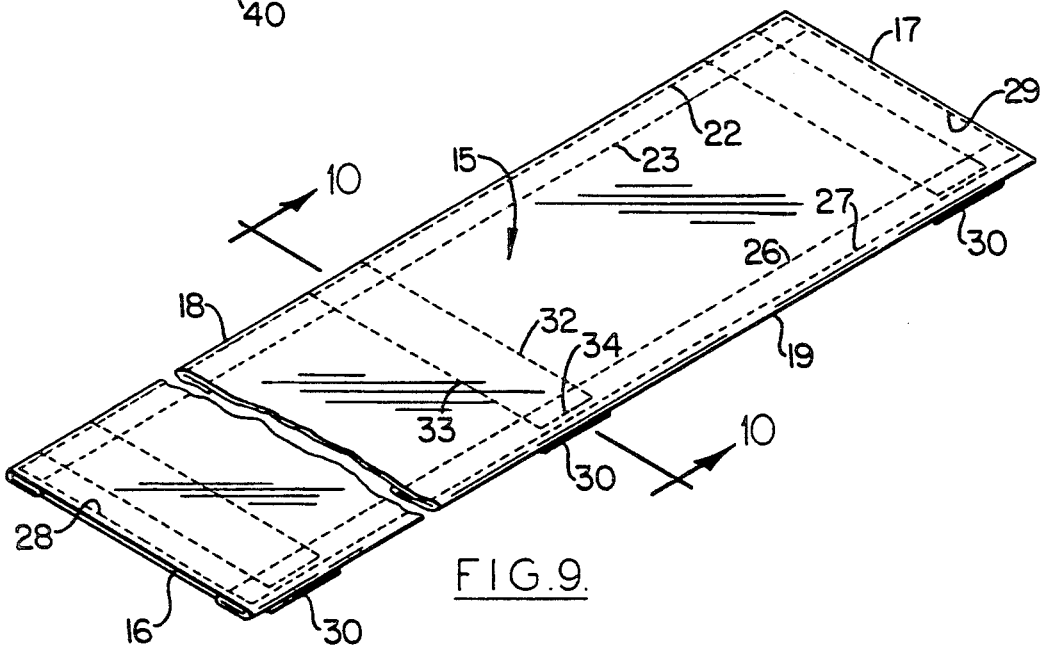
FIG. 9 is a top plan view of the detachable cover.

FIGS. 5–7 illustrate the steps by which the fabric cover 10 may be removably mounted to the wooden side rail 14 of a powerboat or sailboat, and so as to cover and protect the side rail. The cover 10 is initially positioned above the rail as seen in FIG. 5, and then laterally expanded as seen in FIG. 6, and so that the cover may be lowered about the side rail. The pockets may then be released and so that the pockets collapse and encircle the rail upon the release thereof as seen in FIG. 7. The process is reversed to remove the cover.

In the drawings and specification, there has been set forth a preferred embodiment of the invention, and although specific terms are employed, they are used in a generic and descriptive sense only and not for purposes of limitation.

That which is claimed is:

1. A system for protecting the wooden rail of a powerboat or sailboat and which rail has a top and opposite sides, said system comprising a plurality of covers, with each cover comprising an elongate sheet of generally rectangular fabric material and which defines opposite ends and opposite side edges, means defining a plurality of longitudinally spaced apart pockets on one side of said fabric sheet, and with said pockets each extending transversely between said opposite side edges of said fabric sheet, a resilient ring of generally C-shaped cross sectional configuration positioned in each of said pockets, with each of said rings including closely adjacent circumferential ends which are positioned adjacent respective ones of said opposite side edges of said fabric sheet, and such that said rings cause said fabric sheet to assume a conforming C-shaped outline in transverse cross section at each of said pockets, and whereby each of the C-shaped rings may be manually expanded to permit the pockets to be disposed about the wooden rail, and so that the pockets then collapse and the sheet encircles the top and both sides of the rail upon the release of the rings.

2. The cover as defined in claim 1 wherein said means defining a plurality of pockets comprises a strip of sheet material for each of said pockets, with each of said strips extending between said opposite side edges of said fabric sheet, and with said strips being joined to said fabric sheet along two longitudinally spaced apart transverse lines and an end line adjacent one of said side edges, and so that each pocket includes an open end adjacent the opposite side edge of said fabric sheet.

3. The cover as defined in claim 2 wherein each of said strips includes a folded back edge which extends into the associated pocket from said open end of said pocket, and with said folded back edge receiving one of said ends of said C-shaped ring therein and so that said ring is retained in said pocket.

4. The cover as defined in claim 3 wherein said C-shaped rings are composed of a plastic material and have a diameter of about 2.5 inches in their relaxed state.

5. The cover as defined in claim 4 wherein said circumferential ends of each said C-shaped rings are circumferentially spaced apart a distance less than about ½ inches in its relaxed state.

6. The cover as defined in claim 5 wherein the distance between said opposite side edges of said fabric sheet is between about 8 to 10 inches, and the distance between said opposite ends is at least about two feet.

7. The system as defined in claim 1 wherein each of said resilient rings has a cross-sectional configuration which comprises a substantially complete circle.

8. The system as defined in claim 7 wherein each of said rings has a diameter of about 2.5 inches in its relaxed state, and said circumferential ends of each of said rings are circumferentially spaced apart a distance less than about ½ inches in its relaxed state.

* * * * *